US009689224B2

(12) United States Patent
Steine

(10) Patent No.: US 9,689,224 B2
(45) Date of Patent: Jun. 27, 2017

(54) CHANGE-OVER ARRANGEMENT FOR A CABLE OPERATED JAR

(71) Applicant: Brilliant Oil Tools AS, Stavanger (NO)

(72) Inventor: Ken Erik Steine, Hafrsfjord (NO)

(73) Assignee: Brilliant Oil Tools AS, Stavanger (NO)

( * ) Notice: Subject to any disclaimer, the term of this patent is extended or adjusted under 35 U.S.C. 154(b) by 177 days.

(21) Appl. No.: 14/408,793

(22) PCT Filed: Jun. 20, 2013

(86) PCT No.: PCT/NO2013/050113
§ 371 (c)(1),
(2) Date: Dec. 17, 2014

(87) PCT Pub. No.: WO2013/191564
PCT Pub. Date: Dec. 27, 2013

(65) Prior Publication Data

US 2015/0204153 A1 Jul. 23, 2015

(30) Foreign Application Priority Data

Jun. 22, 2012 (NO) ..... 20120728

(51) Int. Cl.
*E21B 31/107* (2006.01)

(52) U.S. Cl.
CPC ..... *E21B 31/107* (2013.01)

(58) Field of Classification Search
CPC ..... E21B 31/107
See application file for complete search history.

(56) References Cited

U.S. PATENT DOCUMENTS

| | | | | |
|---|---|---|---|---|
| 2,025,944 A | | 12/1935 | Fisher | |
| 2,051,911 A | | 8/1936 | Siracusa | |
| 2,190,045 A | | 2/1940 | Raymond | |
| 3,735,827 A | | 5/1973 | Berryman | |
| 4,919,219 A | | 4/1990 | Taylor | |
| 5,022,473 A | * | 6/1991 | Taylor | E21B 31/107 166/178 |
| 5,267,613 A | * | 12/1993 | Zwart | E21B 31/107 166/178 |
| 6,182,775 B1 | | 2/2001 | Hipp | |
| 6,290,004 B1 | * | 9/2001 | Evans | E21B 31/1135 166/178 |

OTHER PUBLICATIONS

International Search Report and Written Opinion for PCT/NO2013/050113, dated Nov. 11, 2013.
Response to Written Opinion for PCT/NO2013/050113, dated Mar. 18, 2014.
International Preliminary Report on Patentability for PCT/NO2013/050113, dated Oct. 2, 2014.

* cited by examiner

*Primary Examiner* — Giovanna C Wright
*Assistant Examiner* — Brandon Duck
(74) *Attorney, Agent, or Firm* — Andrus Intellectual Property Law, LLP

(57) ABSTRACT

A cable-operated jar comprising a releasable coupling is arranged for connection to a piece of downhole equipment, in which a mandrel is connected to a cable comprising a hammer section. The hammer section is arranged to strike, on the release of a mandrel coupling, against a shoulder section in a housing, and the mandrel is pre-tensioned in a releasable position with a spring arrangement. The spring arrangement includes an adjusting mechanism operated by the cable alternately being tensioned and relaxed.

10 Claims, 3 Drawing Sheets

CHANGE-OVER ARRANGEMENT FOR A CABLE OPERATED JAR

CROSS-REFERENCE TO RELATED APPLICATIONS

This application is the U.S. national stage application of International Application PCT/NO2013/050113, filed Jun. 20, 2013, which international application was published on Dec. 27, 2013, as International Publication WO2013/191564 in the English language. The international application is incorporated herein by reference, in entirety. The international application claims priority to Norwegian Patent Application No. 20120728, filed Jun. 22, 2012, which is incorporated herein by reference, in entirety.

FIELD

A cable-operated jar provided with a releasable coupling arranged to be connected to a piece of downhole equipment is described, in which a mandrel connected to a cable is provided with a hammer section arranged to strike, on the release of a mandrel coupling, against a shoulder section in a housing, and the mandrel is pre-tensioned in a releasable position by means of a spring arrangement.

BACKGROUND

In exploration and production activities in the oil and gas industry, cable-operated so-called jars are used when downhole equipment that is stuck is to be retrieved from a borehole. The jar, which, during the freeing operation, is connected to the downhole equipment that is to be freed, includes a jarring mechanism which is releasable by the cable, which connects the jar to a surface installation, being subjected to a prescribed tensioning, and the jarring mechanism strikes against a portion of the jar, thereby applying a stroke impulse to the downhole equipment. According to the prior art, the impact force of the jar is set while the jar is on the surface, and if the set impact force is insufficient to free the downhole equipment from the surrounding structures even after repeated strokes, the jar will have to be released from the downhole equipment, retrieved to the surface, readjusted, lowered down the borehole again, reconnected to the downhole equipment in order then to repeat the jarring operation. It also happens that the set impact force is too large in relation to what is needed, and in such a situation, the downhole equipment may be subjected to unduly heavy strains.

The jarring mechanism in a jar may, in principle, include a dividable mandrel which is accommodated in a housing. In an operative position, the housing is fixed to the downhole equipment by means of a coupling arranged at an end portion of the housing (adapted for a so-called fishing neck, for example). The cable is attached to an end portion of the mandrel remote from the coupling of the housing. By pulling on the cable, the mandrel is moved into engagement between a lock and a portion of the housing while, at the same time, a spring arrangement is tightened by abutment against a first shoulder in the housing. A mandrel coupling, which may form part of the lock, forms a releasable coupling between an upper mandrel section and a lower mandrel section. An adjusting mechanism, for example a nut, functions as a displaceable lower abutment for the spring arrangement.

When the cable is stretched further, the coupling is released, and the upper mandrel section which is provided with a projecting hammer portion, strikes against a second shoulder (anvil) in the housing. The reaction force is transmitted to the downhole equipment which, if the force is large enough, is knocked loose from the surrounding structures.

In addition to the adjusting mechanism of the jar being able to change the stroke characteristics of the jar, the spring arrangement can also be replaced to give the jar a completely different stroke characteristics, for example outside the adjustment range offered by the adjusting mechanism.

U.S. Pat. No. 3,735,827 discloses a hydraulically operated jar, in which a hydraulic fluid in a compression chamber bypasses a compression piston via an unrestricted flow passage us which is normally dosed by a valve. The valve is opened by means of a trigger mechanism which is adjustable in order to vary the tension that must be applied to a cable to open the valve.

U.S. Pat. No. 6,182,775 discloses a jar which includes an elongated housing with a fluid bore extending between the end portions of the housing. Two pistons are displaceably arranged in the housing, each provided with a seat. A valve ball which can be pumped down to the jar through a coiled tubing, for example, may rest against the seat of the upper piston. A dart is arranged between the pistons. A trip mechanism separates the dart from the lower piston at a certain overpressure. Once the plug is separated from the lower piston, the lower piston is moved towards an abutment in the delivering an upward blow to the housing.

SUMMARY

The invention has for its object to remedy or reduce at least one of the drawbacks of the prior art or at least provide a useful alternative to the prior art.

The object is achieved through features which are specified in the description below and in the claims that follow.

The invention relates to a cable-operated jar provided with a releasable coupling arranged for connection to a piece of downhole equipment, in which a mandrel connected to a cable is provided with a hammer section arranged to strike, on the release of a mandrel coupling, against a shoulder section in a housing, and the mandrel is pre-tensioned in a releasable position by means of a spring arrangement, characterized by the spring arrangement including an adjusting mechanism operated by alternately tightening and relieving the cable. Thereby, a jar which is basically adapted for the operation that is to be carried out, for example by the characteristics of the spring arrangement having been chosen within the range that is suitable for the type and dimensions of the downhole equipment to be retrieved, may be readjusted to a larger impact force without having to be disconnected from the downhole equipment and retrieved to the surface.

The adjusting mechanism may include an adjusting sleeve which is axially movable along a portion of a lower mandrel section between a change-over position and various work positions. The jar may thereby be adjusted for constantly increasing impact force, or the jarring operation may be repeated with the same impact force.

Switching between the change-over position and the different work positions may be provided by one of the adjusting sleeve and the lower mandrel section being provided with a guiding groove for a guide device which is arranged on the other one of the adjusting sleeve and the lower mandrel section. The adjusting mechanism may thereby be provided by simple mechanical elements which are not very much affected by temperature, pressure and the compositions of surrounding fluids.

The guiding groove may include several groove sections extending alternately parallel to and at an angle to a longitudinal axis of the jar. An operator on a surface installation thereby has good control of the status of the jar, as the operator, with information available about the operative dimensions of the cable, the travel space of the mandrel and the lengths of the groove sections, can easily determine the amount of cable to be paid out before the adjusting mechanism reaches a change-over position and is adjusted to a changed impact force.

The guiding groove may extend continuously around the entire circumference of the one of the adjusting sleeve and the lower mandrel section in which the guiding groove is arranged. By an erroneous change-over of impact force, it is thereby possible to go back to the desired setting by readjusting step by step through the entire series of available work positions.

The invention also includes a surface installation arranged for cable-operated wellbore maintenance provided with a jar according to the above description.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
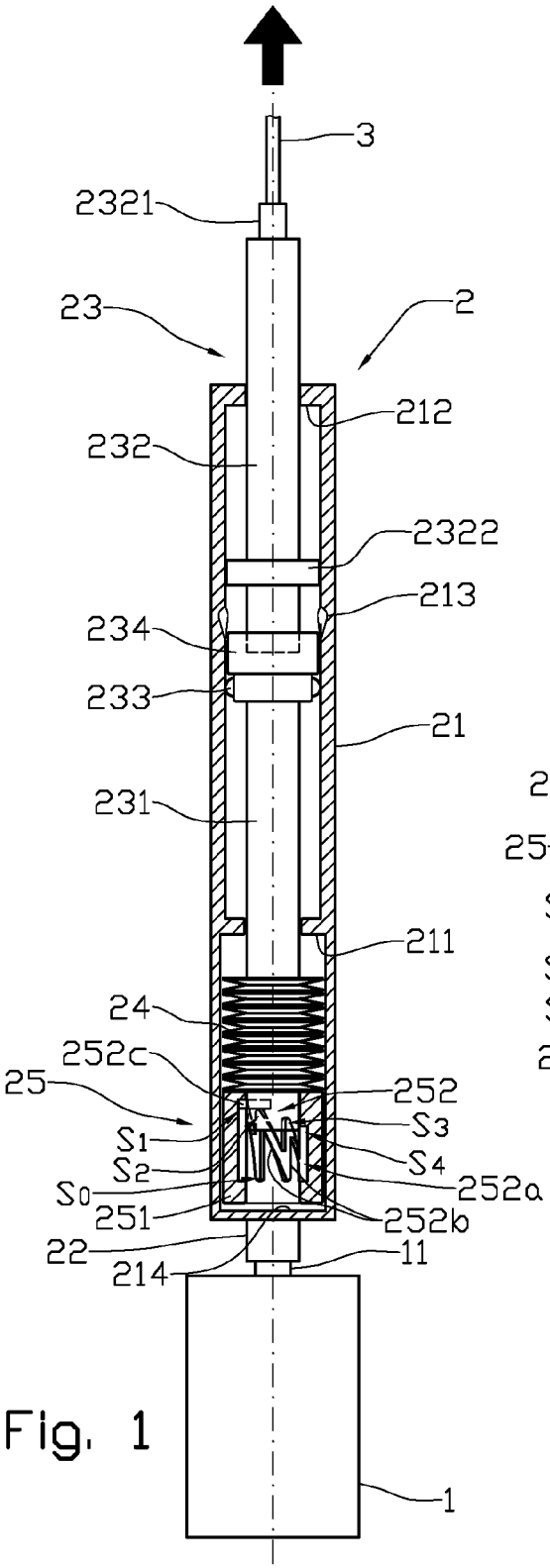
FIG. 1 shows, partially in an axial section, a jar according to the invention in an early phase of the displacement of a mandrel towards a pre-tensioned initial position for freeing a connected piece of downhole equipment.
Figure 1A:
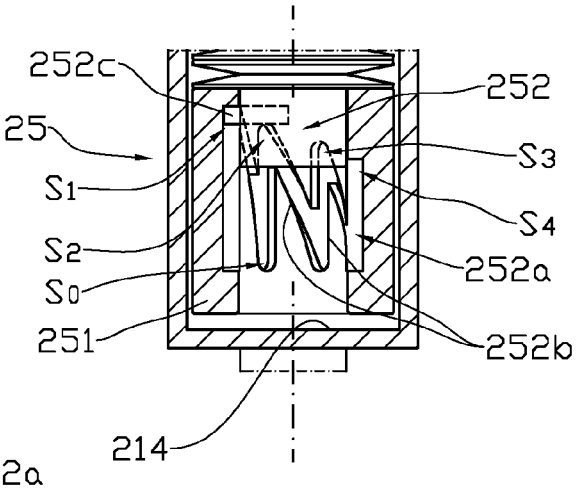
FIG. 1*a* is an enlarged view of a guide device engaged in a guiding groove of an adjusting sleeve of the jar shown in FIG. 1.
Figure 2:
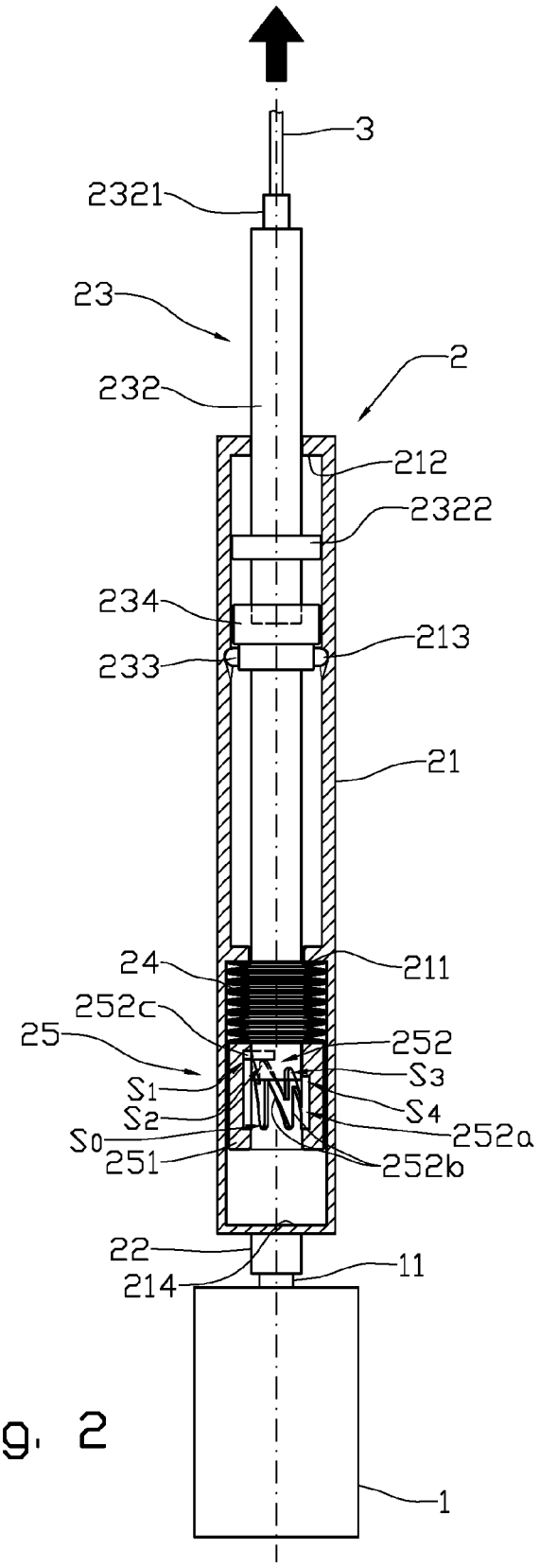
FIG. 2 shows the mandrel fixed in its initial position ready to strike.

In the drawings, the reference numeral 1 indicates a piece of downhole equipment which is to be retrieved from a borehole (not shown). The downhole equipment is provided with a coupling portion, typically a so-called fishing neck 11.

A cable-operated jar 2 is connected to a cable 3 extending up to a surface installation (not shown) provided with means (not shown) known per se arranged for running the cable 3 into and out of the borehole, including positioning connected equipment and applying a prescribed tension to the cable 3.

Figure 3:
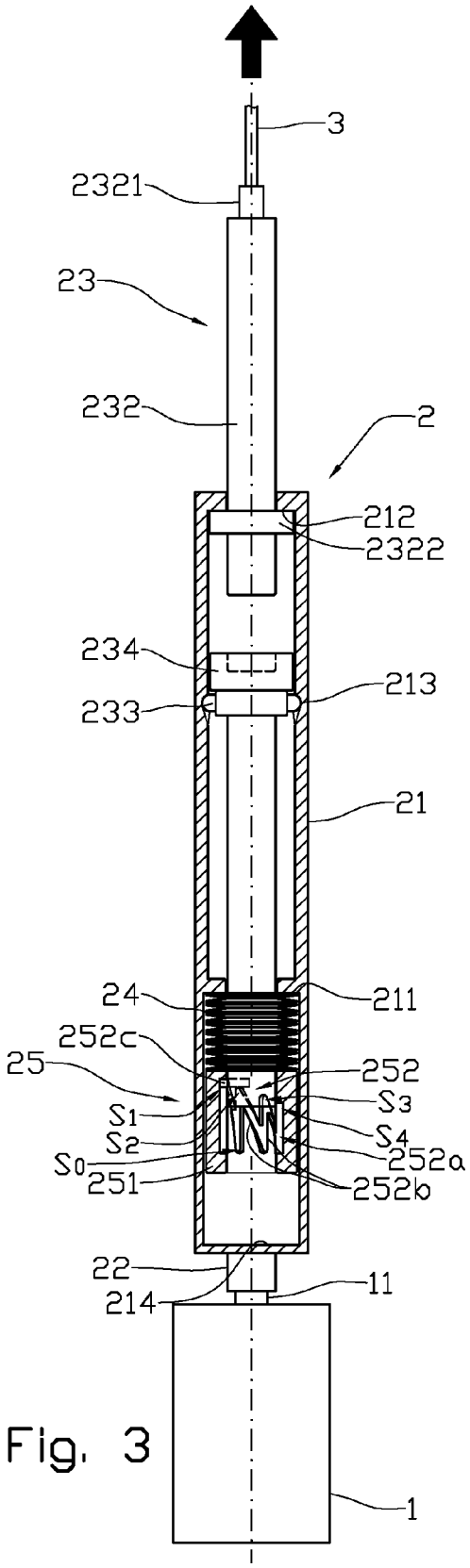
FIG. 3 shows an upper mandrel section released from the mandrel and in abutment against a shoulder portion internally in the jar.
Figure 4:
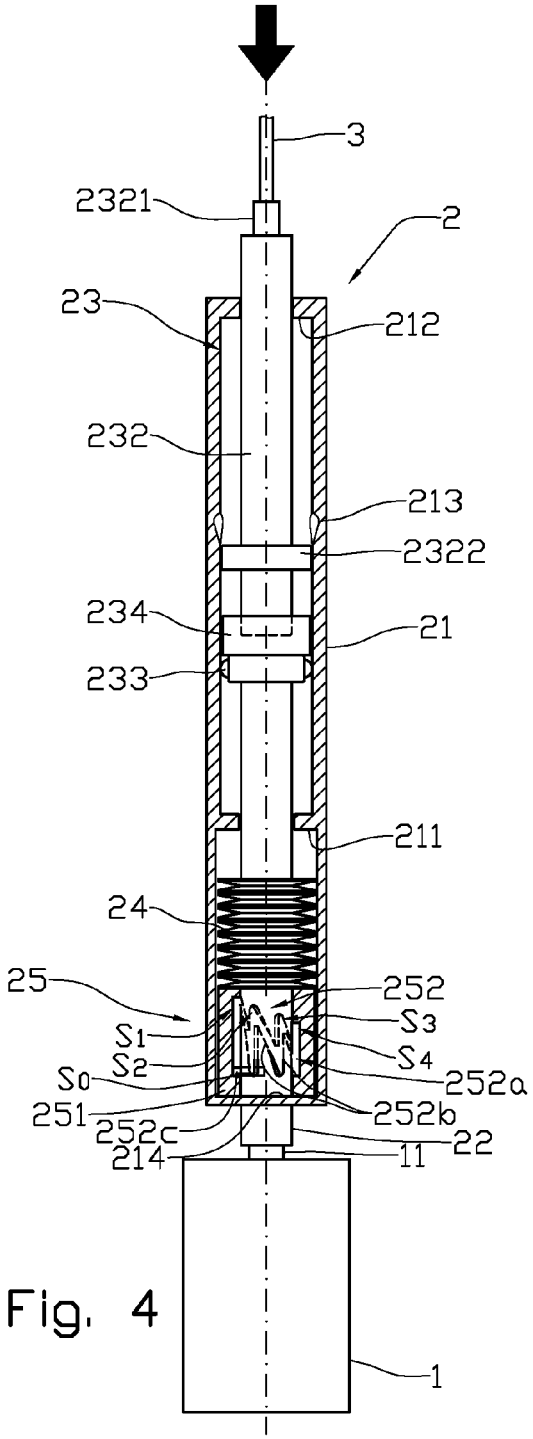
FIG. 4 shows the mandrel moved back into a change-over position for changing the pre-tensioning of the spring arrangement.

The jar 2 is provided with a housing 21, which, at an end portion facing away from the cable 3, is provided with a coupling 22, which is arranged to grip around the coupling portion 11 of the downhole equipment 1. The housing 21 accommodates an elongated mandrel 23. In an end portion opposite the coupling 22, a portion of the mandrel 23 projects from the housing 21 and forms a cable attachment 2321 for connection to the cable 3. The mandrel 23 is dividable at a mandrel coupling 234, which forms an interface between lower and upper mandrel sections 231, 232. The mandrel coupling 234 is adjustable for release when a prescribed tensile force is applied to the mandrel 23 by the connected cable 3. The mandrel coupling 234 is also arranged to connect the two mandrel sections 231, 232 after a separation, by the cable 3 pushing the upper mandrel section 232 towards the lower mandrel section 231. The mandrel coupling 234 is shown here as being integrated in the lower mandrel section 231 (see FIG. 3 in particular), it being assembled with a mandrel lock 233. However, such a positioning and such an assembly are not of vital importance for the function of the invention.

The mandrel lock 233 is arranged to releasably engage an engagement portion 213 internally in the housing 21 in order thereby to fix the mandrel 23 relative to the housing 21 before a stroke by a hammer section 2322 against a (second) shoulder section 212 arranged internally in the housing 21 is triggered. The hammer section 2322 is arranged as a projection on the upper mandrel section 232.

A further (first) shoulder section 211 is arranged as an internal projection in the housing 21, the shoulder section 211 surrounding the circumference of the lower mandrel section 231 and forming an abutment for a spring arrangement 24. The spring arrangement 24 surrounds a portion of the lower mandrel section 231 and is axially supported by an adjusting mechanism 25 arranged on the end portion of the lower mandrel section 231 facing away from the mandrel coupling 234.

The adjusting mechanism 25 includes an adjusting sleeve 251, which is axially movable on an end portion of the lower mandrel section 231. During the axial displacement, a sleeve guide 252 provides for the adjusting sleeve 251 to switch between an unloaded change-over abutment $S_0$, in which the adjusting sleeve 251 is resting on a bottom portion 214 of the housing 21 and the mandrel 23 has been moved maximally into the housing 21, and a work abutment $S_1, S_2, \ldots, S_n$, shown in the figures as $S_1$, $S_2$, $S_3$ and $S_4$, in which the mandrel 23 has been pulled upwards relative to the adjusting sleeve 251. The sleeve guide 252 includes a guiding groove 252*a*, shown here as being arranged in an internal wall of the adjusting sleeve 251 and being made up of several groove sections 252*b* lying alternately in the longitudinal direction of the jar 2 and partially at an angle relative to said longitudinal direction. At each lower transition between two groove sections 252*b*, the guiding groove 252*a* forms a change-over abutment $S_0$ for a guide device 252*c*, shown here as a guide pin projecting from the lower mandrel section 231. In the embodiment shown, the change-over abutments $S_0$ have the same axial position. In each upper transition between two groove sections 252*b*, the guiding groove 252 forms a work abutment $S_1, S_2, \ldots, S_n$, shown in the figures as $S_1$, $S_2$, $S_3$ and $S_4$, for the guide device 252*c*. The work abutments $S_1, S_2, \ldots, S_n$ have different axial positions, preferably stepping down gradually between a first position, which provides the largest distance between the adjusting sleeve 251 and the first shoulder portion 211 when the mandrel 23 is fixed in the locked position, and a last position, which represents the smallest distance mentioned, in order thereby to result in a different compression of the spring arrangement 24 when the jar 2 has been prepared for a stroke. The number of work positions and the axial distance between them may be adapted to the requirements existing.

When downhole equipment 1 is to be knocked loose and retrieved from a borehole by means of the jar 2, the jar 2 is prepared on the surface by a suitable spring arrangement 24 and adjusting mechanism 25 being fitted in the jar 2 in accordance with, for example, the dimensions of the downhole equipment 1 and expected need for impact force to get the downhole equipment 1 loose. The adjusting sleeve 251 is preferably set to a first position $S_1$. The jar is then connected to the cable 3 and lowered down the borehole to be connected to the downhole equipment 1.

If the selected position $S_1$ represents the desired impact-force setting, the mandrel 23 is pulled up into its locked position with the mandrel lock 233 engaged in the engagement portion 213 of the housing 21. If, on the other hand, it is desirable to change the impact force of the jar 2, the mandrel 23 is lowered back into the housing 21, preferably without the mandrel lock 233 engaging the engagement portion 213 of the housing 21, so that the sleeve guide 252 reaches the change-over abutment $S_0$ in the guiding groove 252*a*. After that, the mandrel 23 is pulled anew until the sleeve guide 252 abuts against the next work abutment $S_1$, $S_2$, . . . , $S_n$. The change-over is repeated until the desired setting has been achieved and the mandrel lock 233 engages the engagement portion 213 of the housing 21. The tension on the cable 3 is increased, and the mandrel coupling 234 is released. The upper mandrel section 232 strikes with its hammer section 2322 against the second shoulder section 212, and the recoil from the stroke propagates through the housing 21 and coupling 22 to the connected downhole equipment 1. If the impact force achieved is too small, the jarring operation is repeated after a change-over of the adjusting mechanism 25 to another one of the work abutments $S_1$, $S_2$, . . . , $S_n$, possibly a new stroke being carried out with the same setting.

In an advantageous embodiment, the mandrel coupling 234 is released as the mandrel lock 233 engages the engagement portion 213 in the housing 21. Thereby the impact force achieved is determined entirely by the force that the cable 3 must exert on the mandrel 23 to get the spring arrangement 24 compressed according to the set distance between the adjusting sleeve 251 and the first shoulder portion 211.

The invention claimed is:

1. A cable-operated jar comprising a releasable coupling arranged for connection to a piece of downhole equipment, in which a mandrel, which is connected to a cable, comprises a hammer section which is arranged to strike, on the release of a mandrel coupling, against a shoulder section in a housing accommodating the mandrel, and the mandrel is pre-tensioned in a releasable position with a spring arrangement including an adjusting mechanism operated by alternately tensioning and relieving the cable, wherein the mandrel has an upper section configured to be releasably connected to a lower mandrel section by the mandrel coupling which is movable into and out of engagement with an engagement portion fixed inside the housing;

the housing includes a bottom portion and a further shoulder section fixed to the housing between the mandrel coupling and the bottom portion; and the adjusting mechanism is configured for adjustment from within the housing, and includes an adjusting sleeve which is axially slidable along an inner surface of the housing, and also includes a guide device engaged for axial movement between a change-over abutment in which the spring arrangement is disengaged from the further shoulder section and the adjusting sleeve rests on the bottom portion of the housing, and a number of different work abutments formed in a guiding groove which extends continuously with respect to the inner surface of the housing, wherein the work abutments have different axial positions which provide a desired distance between the adjusting mechanism and the further shoulder section to enable contact of the spring arrangement with the further shoulder section and cause compression of the spring arrangement upon axial movement of the mandrel until the mandrel coupling engages the engagement portion thereby releasing the upper mandrel section from the lower mandrel section, and causing the hammer section to strike the shoulder section and transmit an impact force to the downhole equipment.

2. The jar in accordance with claim 1, wherein the guiding groove comprises several groove sections extending alternately parallel to and at an angle to a longitudinal axis of the jar.

3. The jar in accordance with claim 1, wherein the housing has a top portion defining the shoulder section.

4. The jar in accordance with claim 1, wherein the adjusting sleeve is axially slidable along the lower mandrel section and includes the guiding groove.

5. The jar in accordance with claim 4, wherein the guide device is a guide pin projecting from the lower mandrel section.

6. The jar in accordance with claim 4, wherein the guiding groove extends continuously around the entire circumference of the adjusting sleeve.

7. The jar in accordance with claim 1, wherein the mandrel coupling includes a mandrel lock.

8. The jar in accordance with claim 7, wherein the mandrel lock is configured to be engaged and disengaged with an engagement portion formed internally in the housing.

9. The jar in accordance with claim 1, wherein the mandrel coupling is configured to release when a prescribed tensile force is applied to the mandrel by the cable.

10. The jar in accordance with claim 1, wherein the spring arrangement has an upper end which is engaged with and disengaged from the further shoulder section, and a lower end which is continuously engaged with the adjusting mechanism.

* * * * *